United States Patent [19]

Rohatin

[11] 4,438,387

[45] Mar. 20, 1984

[54] TURN-ON CONTROL SYSTEM FOR VOLTAGE DROP COMPENSATORS

[76] Inventor: Frederick Rohatin, 166-10 - 15th Dr., Whitestone, N.Y. 11357

[21] Appl. No.: 271,202

[22] Filed: Jun. 8, 1981

[51] Int. Cl.[3] ..... G05F 1/24

[52] U.S. Cl. ..... 323/260; 323/256

[58] Field of Search ..... 323/256, 257, 259, 260, 323/263, 301, 302, 344

[56] References Cited

U.S. PATENT DOCUMENTS

| | | | |
|---|---|---|---|
| 2,966,626 | 12/1960 | Kalina et al. | 323/260 |
| 3,044,008 | 7/1962 | Cooley | 323/256 |
| 3,287,624 | 11/1966 | Perry | 323/256 |

*Primary Examiner*—William H. Beha, Jr.

[57] ABSTRACT

A turn-on control system for series variable transformer type voltage drop compensators comprising a voltage corrective variable compensating winding in combination with a voltage sensing main control to sense the voltage deviations of the utility's incoming service line with respect to a given reference voltage and a regulating control which operates the variable compensating winding. Upon occurrence of a power brownout the voltage corrective assumes its highest corrective position. Upon blackout the control system actuates the disconnection of the voltage corrective variable compensating winding and regulating control. Upon return of power the voltage corrective variable compensative winding is first placed at its lowest corrective position and the subsequent reconnecting of the voltage corrective control operation is effected. Thus it provides full protection against the disastrous effect of excessive steady-state overvoltages upon return of power, in particular, for computer voltage stabilizer applications.

10 Claims, 7 Drawing Figures

LINE
NEUTRAL
10
10A
17A
17
CONTACTOR
15F
11
12
S
10B
13
17B
13A
13B
17C
MOTOR
LOWER
15
RAISE
16
16B
FEEDBACK CIRCUIT
LOWER
15B
SERVO AMP
17D
REFERENCE SIGNAL CIRCUIT
16C
15C
16A
RAISE
17E
14
LOAD

TURN-ON CONTROL SYSTEM FOR VOLTAGE DROP COMPENSATORS

BACKGROUND OF THE INVENTION

This invention relates to general voltage drop compensating type transformer power supply systems with Turn-On control feature to prevent accidental burnout of the supplied load equipment. More specifically stated, it relates to a novel Turn-On control system for voltage drop compensators to provide full protection against overcompensation upon restoration of the power supply voltage immediately following a Utility blackout.

There are various commercially available automatic voltage drop compensators being equipped with automatic controls sensing the Utility's line voltage fluctuations. Normally the control units comprise a reference circuit generating a DC signal remaining constant regardless of the incoming line voltage variations. Further it consists of a feed-back circuit to produce a feed-back signal being continuously compared with the magnitude of the reference signal. Thus at any time-moment their differences resulting in a corresponding error signal-positive or negative- to provide a proportionate corrective control on the voltage drop compensator to reestablish the required constant operating voltage on the load.

Generally the maximum voltage correction capacity of all voltage drop compensators amounts to +20% of the rated Utility service line voltage. Consequently following a slow blackout, at the time-moment of power return, the voltage drop compensator's setting will unavoidably be at its highest corrective output voltage, which will subsequently result in an excessive over-voltage compensation. More particularly in Computer Voltage Stabilizer applications, such over-voltage compensation will cause diastrous damaging effect on the computer equipment and possibly may even destroy it.

For series transformer type voltage drop compensators equipped with variable voltage transformer, the turn-on control system comprises a contactor-coil with a plurality of operatively interlocking switching contacts to perform switching operations in a predetermined succession consisting of disconnecting and subsequent resetting the variable voltage transformer to its lowest corrective position with following reconnection to resume automatic voltage corrective operation.

Further structural feature of the turn-on control system provides a time-delay action to allow the controlling motor device sufficient time to reach a full stop before the reversal of the controlling action shall take place.

More specifically stated, this invention relates to a novel Turn-On control system to safely prevent the occurrence of such damaging effects noted above. In accordance with the invention the control system shall be activated at the moment of blackout or power feeding interruption by applying the following method:

In a predetermined sequential order, at first the compensator's control device shall be made inoperative, then it shall be reset to zero position or apparatus lowest voltage so that after restoration of normal power it becomes again operative, whereby no over-voltage can occur.

OBJECTS OF THE INVENTION

One of the main objects of the invention is to provide a Turn-On control system for voltage drop compensators to comprise a combination of means actuating at the moment of power blackout the disconnection of the compensator's control unit with subsequent resetting same to zero or lowest apparatus output voltage position immediately after restoration of normal power and the following reconnection to re-establish -automatic-compensating control operation.

A further specific object of the invention is to apply time delay means for the motor control of the compensator as being necessary to prevent possible damaging actions.

Further objects of the invention lie in the combination of the various above mentioned arrangements to form various complete combined voltage drop compensator power supply systems and also include the various subcombinations of the elements and their interrelation.

The objects of the invention will become more evident from the detailed descriptions presented in conjunction with the accompanying drawings and for better understanding reference will be made to them in which:

BRIEF DESCRIPTION OF THE DRAWING FIGURES

DESCRIPTION OF THE PREFERRED EMBODIMENT

Figure 1:
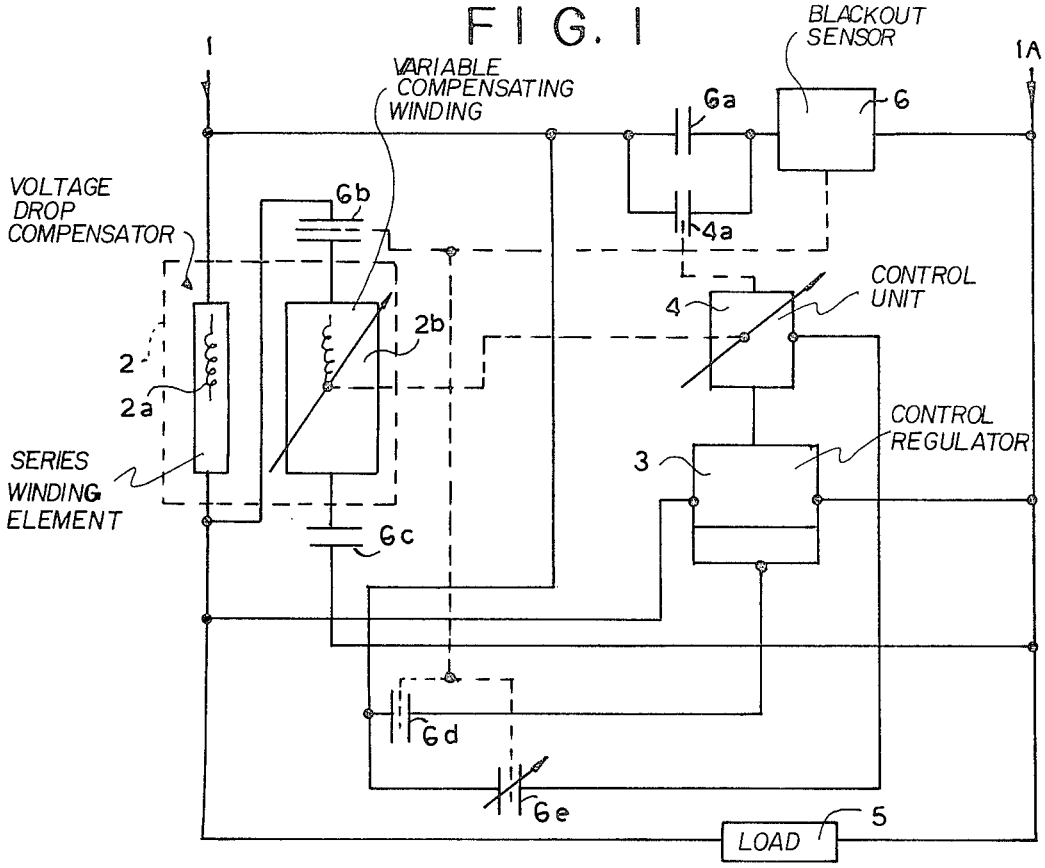
FIG. 1 represents a diagrammatic illustration of the basic principle of the invention indicating the general circuit diagram of the Turn-On control system and FIG. 1A indicates the time-diagram of the sequential operation.

Referring more particularly to FIG. 1 in which a diagrammatic view of the basic principle of this invention is presented to form a complete Turn-On control system operating in conjunction with the voltage drop compensator. The specific feature consists of performing sequential switching operations upon occurrence of a slow blackout or full power failure to provide protection against any possible damaging actions.

In this block diagram reference numeral 1 denotes the incoming Utility's line voltage shown as a single phase line with the neutral 1A. The voltage drop compensator generally indicated at 2 incorporates a series element *2a* and a variable compensating element *2b* in inductive relation with each other. A load denoted by the reference numeral 5 is connected between the corrected line voltage and neutral Similarly the compensator element *2b* is connected between the corrected line voltage and neutral. A control regulator denoted by the reference numeral 3 is adapted to produce an error signal in proportion to the voltage difference between a determined reference voltage and fluctuating line voltage. The compensator's setting control unit denoted by the reference numeral 4 is in operational relationship and interlocked with the variable compensator 2*b*.

In accordance with the invention the Turn-On control system unit denoted by the reference numeral 6 basically constitutes a blackout sensing element incorporating the switching elements 6*a*,6*b*,6*c*,6*d*,6*e* in operational relationship therewith to be actuated in case of blackout. The switching element 6*a* is connected in series with the turn-on control unit 6, the switching elements 6*b*,6*c* are connected in series with the terminals of the variable compensator 2*b*, The switching element 6*d* is in series with the regulator unit 3. However, the switching element 6*e* is connected between the line and the compensator's setting control unit 4, incorporating another switching element 4*a* in operational relationship thereto and connected in parallel to the switching element 6*a*.

Under automatic operating conditions the switching elements 6*a*,6*b*,6*c*,6*d* are initially closed, whereas the switching elements 6*e* and 4*a* are initially open so that the voltage drop compensator provides the required corrective voltage compensation.

Figure 1A:
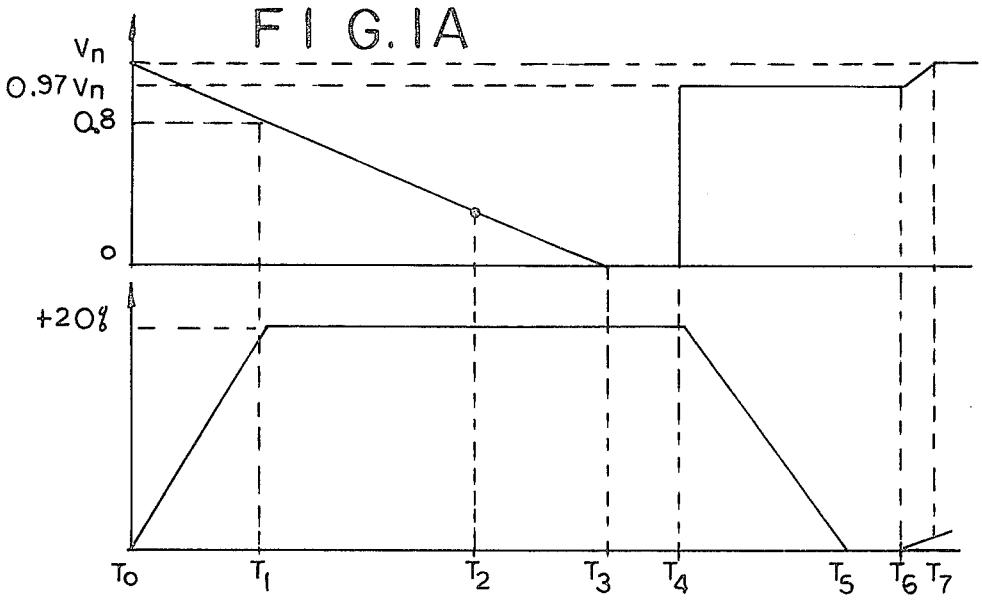

When a slow blackout occurs, the sequential switching operation of the Turn-On control system can be best understood by inspecting the time-diagram shown on FIG. 1A.

At the time moment $T_0$ the output voltage has the normal magnitude $V_n$ and the setting of the voltage corrective means or compensator is at the approximate position of the lowest apparatus output voltage. When the slow blackout occurs, a drop of voltage to the magnitude 0.8 $V_n$ takes place at the time-moment $T_1$ and at $T_2$ time the automation process is fully cut-off by the voltage corrective means. Subsequently its voltage corrective position moves-up to the maximum +20% position and holds it during the full time-period of the blackout.

It follows that at the time-moment $T_2$ the Turn-On control unit 6 becomes de-activated due to loss of voltage below a given minimum value, therefore it will actuate the opening of the switching elements 6*a*,6*b*,6*c*,6*d*, resulting, in turn, in the interruption of the power supply to the variable compensator 2*b* and and regulator unit 3. Note that the voltage drops to zero for the time monent $T_3$.

Following the restoration of power at the time-moment $T_4$, the power supply to the variable compensator 2*b* and regulator unit 3 is still interrupted, however, the normal power starts to flow through the load 5 and since the switching element 6*e* is closed, it will initiate the activation of the compensator's setting control unit 4 which, in turn, actuates the required resetting of the variable compensator to the position of lowest apparatus output voltage at the time-moment $T_5$. Since the switching element 4*a* is in operational relationship with the setting control unit 4, as a consequence it becomes activated to change its open to closed position causing the power flow into the blackout sensing control unit 6. Immediately following this action, at time-moment $T_6$, the switching elements 6*a*,6*b*,6*c*,6*d* become closed causing the complete reconnection of the variable compensator 2*b* and the switching elements 6*e* and 4*a* re-open. At $T_6$ voltage output rises to 0.97 $V_n$ and reaches $V_n$ at $T_7$.

Accordingly, the variable compensator 2*b* becomes also activated at the time-moment $T_6$ to resume automatic voltage correcting control action as indicated. It is quite evident that the compensator's output voltage changes immediately to provide the controlled stabilized output voltage, whereby the danger of over-voltage at the moment of power restoration is eliminated.

Figure 2:
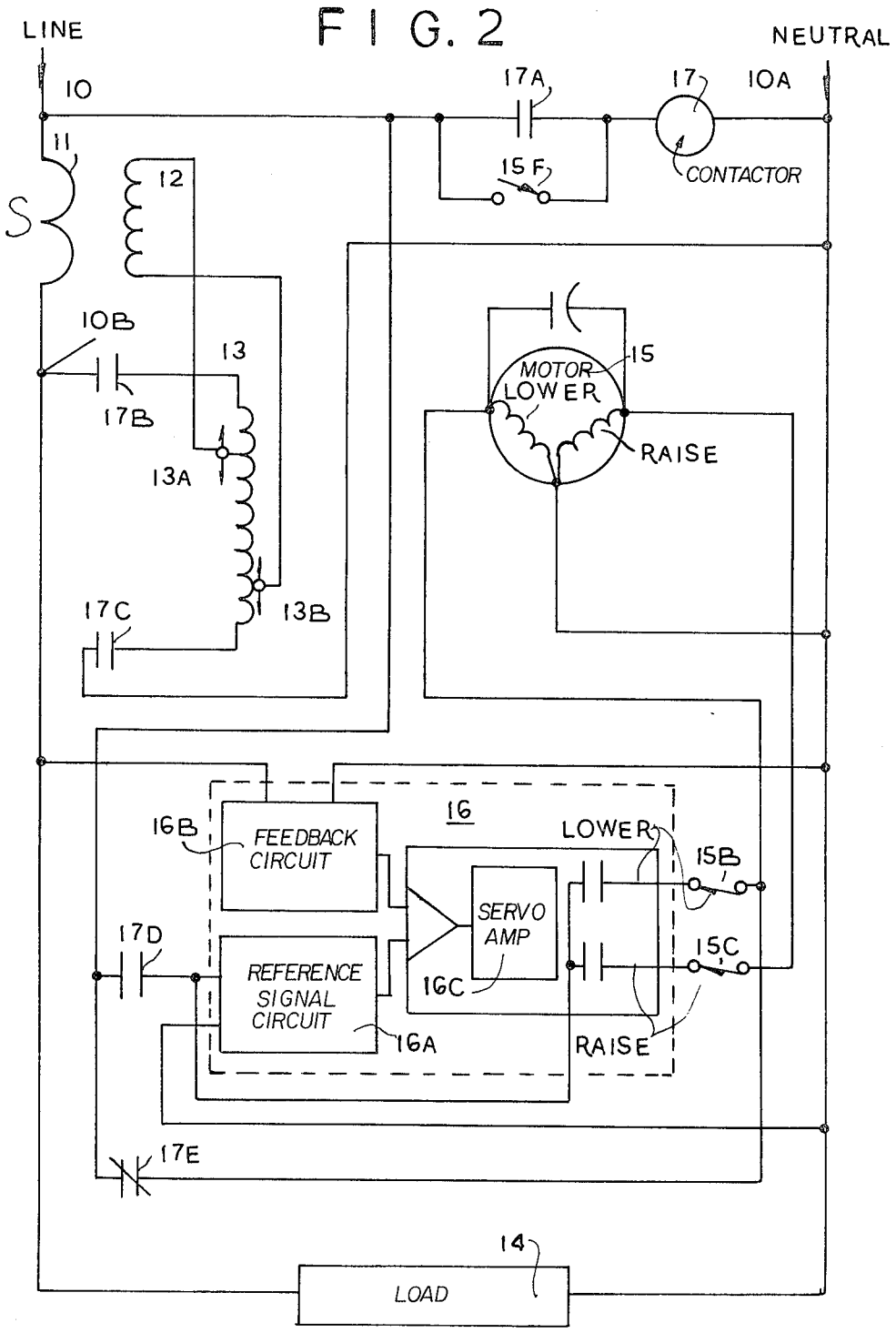
FIG. 2 represents a diagrammatic illustration of the Turn-On control system of the invention as applied to a series variable transformer type voltage drop compensator.

FIG. 2 represents a diagrammatic illustration of the complete Turn-On control system in accordance with the invention. as applied to a series variable transformer type voltage drop compensator utilized as a Computer Voltage Stabilizer to provide full protection against disastrous damaging effects on the computer equipment following a slow and/or full blackout of the Utility's power supply. In fact, the excessive over-voltages occurring upon restoration of power are eliminated.

In this configuration the reference numeral 10 denotes the Utility's incoming service line voltage to be shown as a single phase diagram. The voltage stabilizer comprises a series transformer having a secondary winding denoted by the numeral 11 and a primary winding denoted by the reference numeral 12. The secondary winding 11 being connected between the Utility's service line and the load denoted by the reference numeral 14. The primary winding 12 being fed by a variable transformer denoted by the reference numeral 13 which, in turn, is connected between the corrected line 10B and the neutral 10A. The variable transformer 13 further comprises two current collection carbon rollers 13A, 13B, traveling in opposite directions and being driven by a motor denoted by the reference numeral 15, which, in turn, is automatically controlled by a conventional regulator unit generally indicated at 16. Such a regulator unit generally includes a reference signal circuit 16A comprising a step-down isolating transformer, a zener diode reference circuit and a setpoint potentiometer, not shown here. This signal circuit produces a DC voltage signal which remains practically constant irrespective of the Utility's voltage fluctuations. The regulator unit further comprises a feedback circuit 16B which senses the Stabilizer's voltage at its output terminal or at the load point, thereafter steps it down, rectifies it, whereby it produces a feedback signal. The regulator unit further comprises a servoamplifier 16C adapted to constantly compare the magnitude of the feedback signal to the magnitude of the reference signal resulting in an error signal of certain magnitude and of positive or negative polarity. Finally the amplified error signal terminates into a "Lower" or "Raise" control power circuit, which upon activation energizes the motor's "Lower" or "Raise" winding.

Under operation the motor 15 actuates the movement of the current collectors 13A, 13B, causing a change in the voltage delivered by the variable transformer 13 to the primary winding 12 of the series transformer 13. As a consequence, it will change the voltage induced in the secondary winding 11 which represents an additive or substractive component from the incoming Utility's power line voltage to constitute a new compensated output voltage of the Voltage Stabilizer. The direction of the change of the compensating voltage is to progressively decrease the absolute magnitude of the error produced by the regulator unit 16.

Now, when a slow blackout occurs, regulator 16 will sense a never-ending undervoltage which, in turn, will produce a never-ending "Raise" signal. Consequently, the motor 15 rotates in the "Raise" direction causing a travel of the current collectors until they reached their top position. This will result in a maximum voltage addition of about +20% of the rated Utility service line voltage, a magnitude which will destroy the computer's electronic components.

Since the above described Voltage Stabilizer and its automatic voltage regulating control system is well known to those skilled in the art, therefore no further details are given. Be it noted that the above described systems form no part of the present invention.

The novel Turn-On control system in accordance with the invention includes various elements to operate in conjunction with the Voltage Stabilizer unit. It comprises mainly a contactor denoted denoted by the reference numeral 17 with its coil being inserted between the incoming power line 10 and neutral 10A to be permanently energized under normal operation. It is further equipped with 2 main contacts and 3 auxiliary contacts. In addition, one additional N.O. "Lower" limit switch performs a required control function.

The NO auxiliary contact 17A is inserted in series with the contactor coil, the NO main contacts 17B, 17C connect and disconnect the variable transformer 13 from the lines 10A, 10B. When the contactor coil is energized, these three contacts are closed and therefore the variable transformer is energized. Furthermore a second NO auxiliary contact 17D in the regulator circuit is also closed to feed current as required for the automatic control operation. A third auxiliary NC contact 17E is connected between the power line 10 and lower motor winding circuit being now open, has no function to perform. This condition represents the normal operation of the Voltage Stabilizer unit, when the contactor is energized.

Figure 2A:
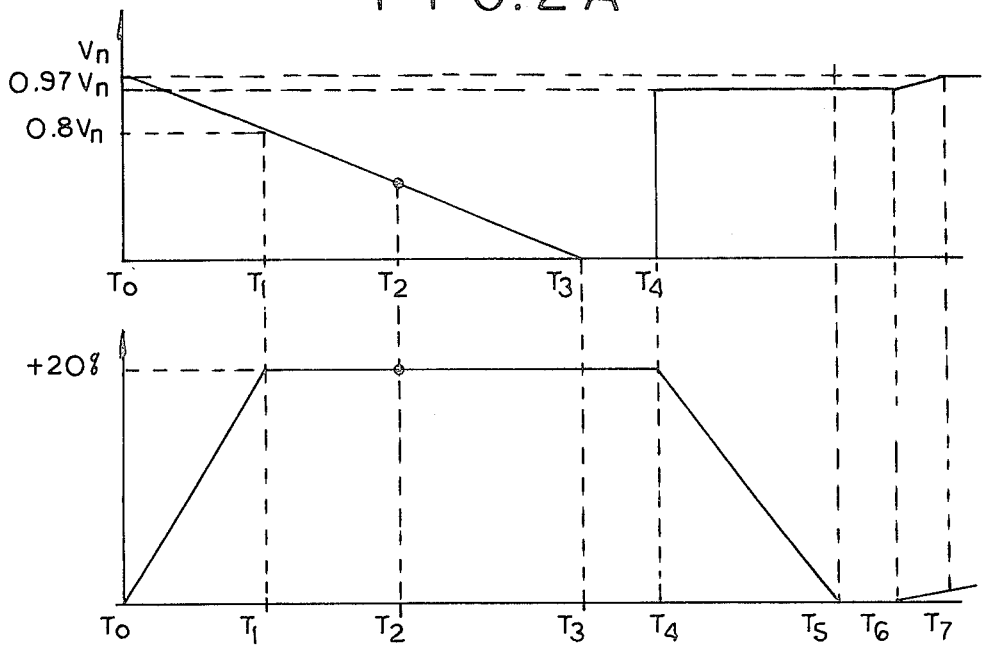
FIGS. 2A & 2B are time-diagrams, with FIG. 2B representing prior art.
Figure 2B:
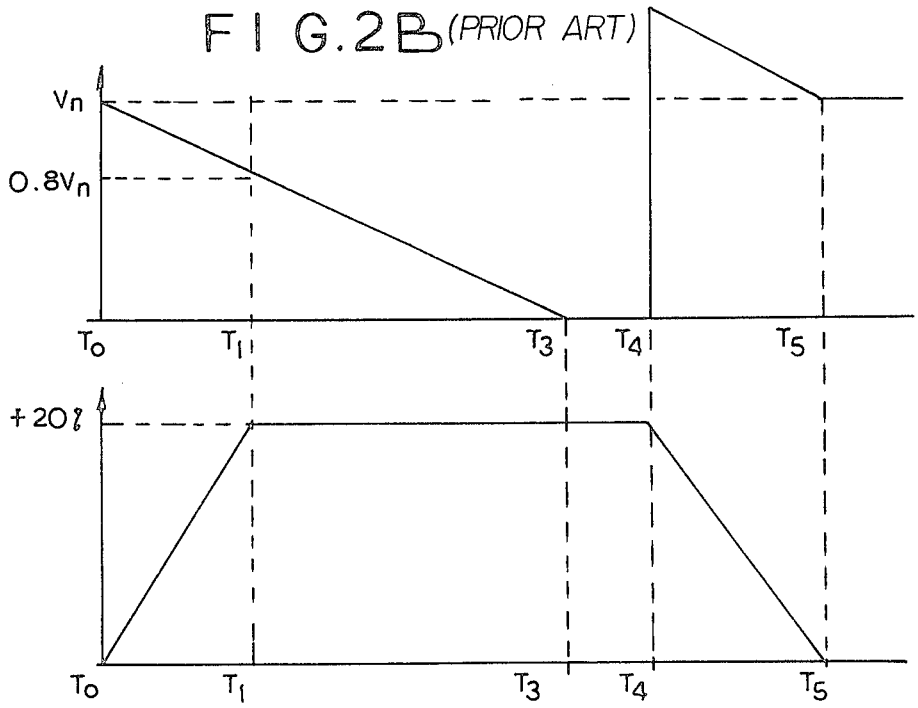
FIG. 2B (PRIOR ART)

In accordance with the invention the sequence of operation of the Turn-On control system arrangement working in conjunction with the Voltage Stabilizer is indicated for better understanding on the time-diagram of FIG. 2A.

Accordingly the time diagram 2A represents the sequential operation of the voltage drop compensator or Stabilizer in accordance with the invention, whereas the time-diagram 2B represents the sequential operation of the conventional prior art voltage compensators. It is noted that on both time-diagrams 2A,2B, the upper portion indicates the time variation of the voltage compensators or Stabilizers output voltage, whereas the lower portion indicates the time-variation of the position of the Stabilizers voltage corrective means.

Let us assume that a slow blackout occurs at the time-moment $T_0$ and the magnitude of the output voltage of the voltage compensator or Stabilizer drops from normal $V_n$ to 0.8 $V_n$ at the time-moment $T_1$. During the time period from $T_0$ to $T_1$ the voltage correction of the variable transformer 13 moves to its highest position +20% compensation. Thereafter the blackout progresses further and at the time-moment $T_2$ the automation function of the voltage transformer or Stabilizer is fully cut-off. This is due to the fact that the contactor's coil 17 becomes de-energized and drops out with subsequent opening of the contact 17A and main contacts 17B, 17C, so there is a disconnection of the contactor's coil circuit and disconnection of the supply of power to the variable compensating transformer 13. At the same time-moment $T_2$, also the auxiliary contact 17D is opened and power is disconnected from the regulator unit 16. Note that as the blackout further progresses, the output voltage drops to zero at the time-moment $T_3$, and the position of the voltage corrective means remains at its highest position.

Upon restoration of power at the time-moment $T_4$, the output voltage suddenly rises to only about 0.97% $V_n$ value because: (a), the voltage corrective means of the variable transformer 13 are out of function due to its power feeding disconnection, (b), the series transformer primary becomes its secondary with the variable transformer being now a damping load.

Following restoration of power at the time-moment $T_4$, the contactor-coil continues to remain de-energized, its contacts 17A, 17B, 17C, 17D, remain open and so the supply of power to the variable transformer 13 remains interrupted. The position of the current collectors remain at their highest location. Also the regulator unit 16 is prevented from automatic operation due to its opened contact 17D. Following such momentary conditions the sequence of switching operations after restoration of power is as follows:

At the time-moment $T_4$ the auxiliary contact 17E is closed, whereby it initiates the activation of the "Lower" winding of the motor 15 interconnecting the power thereto through the added wiring circuit. Consequently, the motor 15 is moving in the "Lower" direction until the rolling current collectors 13A, 13B, will hit their lowest extreme position. This action completes the "Resetting" of the variable transformer 13 to a position of lowest output voltage at the time-moment $T_5$.

At said time-moment the regulator LOW stop NC limit switch 15B disconnects the motor 15 causing the stoppage of the regulating mechanism. Under the same action, the NO new separate limit switch 15F closes to re-energize the coil of the contactor 17.

By now the contactor coil 17 becomes self-fed via its own contact 17A. Following this action also the main contacts 17B, 17C become closed to effect the definite "reconnection" of the variable transformer at the time-moment $T_6$ which, in turn, makes possible the resumption of automatic compensating voltage control operation with its corrective voltage $V_n$ being reached at the time-moment $T_7$. At the closing of the Turn-On control system operating cycle the contact 17D becomes closed to operate the regulator unit 16 and the added wiring circuit to the "Lower" limit switch 15B becomes interrupted.

As a result, the automatic control operation of the voltage compensator or Stabilizer restarts at the moment $T_6$ and so its output voltage starts changing immediately to conform to the required output voltage level at the time-moment $T_7$. This is accomplished by the current collectors moving automatically to a position of correct compensating voltage.

It shall be noted that sometimes it is desirable to impose upon the variable transformer a time-delay action to perform the starting of the automatic operation. More detailed description is presented under FIG. 2D.

By inspecting the time-diagram 2B which, once again, represents the old art preceding this invention, we see no drop-out of the contactor at time-moment $T_2$, because at the conventional voltage drop compensator systems there is no such contactor. It is also important to note that at the restoration of power at the time-moment $T_4$ an instantaneous rise of the output voltage to dangerous levels takes place which may destroy the critical load or the computer. As indicated, the output voltage declines to its normal level only at the time-moment $T_5$.

It is to be noted that when the actual blackout occurs, the contactor becomes de-energized and drops-out. As a consequence, the energization into the input of the variable compensating transformer is cut-off, so there is no voltage applied from the variable transformer to the series transformer primary winding 12 and also there is no EMF being induced in the series transformer secondary winding 11.

Accordingly a functional reversal of the windings of the variable transformer takes place such that its secondary becomes the primary and its primary becomes the secondary. Consequently, winding 12 operating as a secondary will form a closed circuit through the variable transformer which acts as a damping circuit.

When the variable transformer 13 is disconnected from the power lines 10–10A at the first stage of power restoration and load current flows through the secondary winding 11 of the series transformer, current is induced in its primary winding 12 circulating through a portion of the variable transformer which acts at this moment like a choke load and causes a slight voltage drop across the series transformer winding 11. Thus the output voltage becomes equal to the input voltage reduced by the noted slight voltage drop.

Figure 2C:
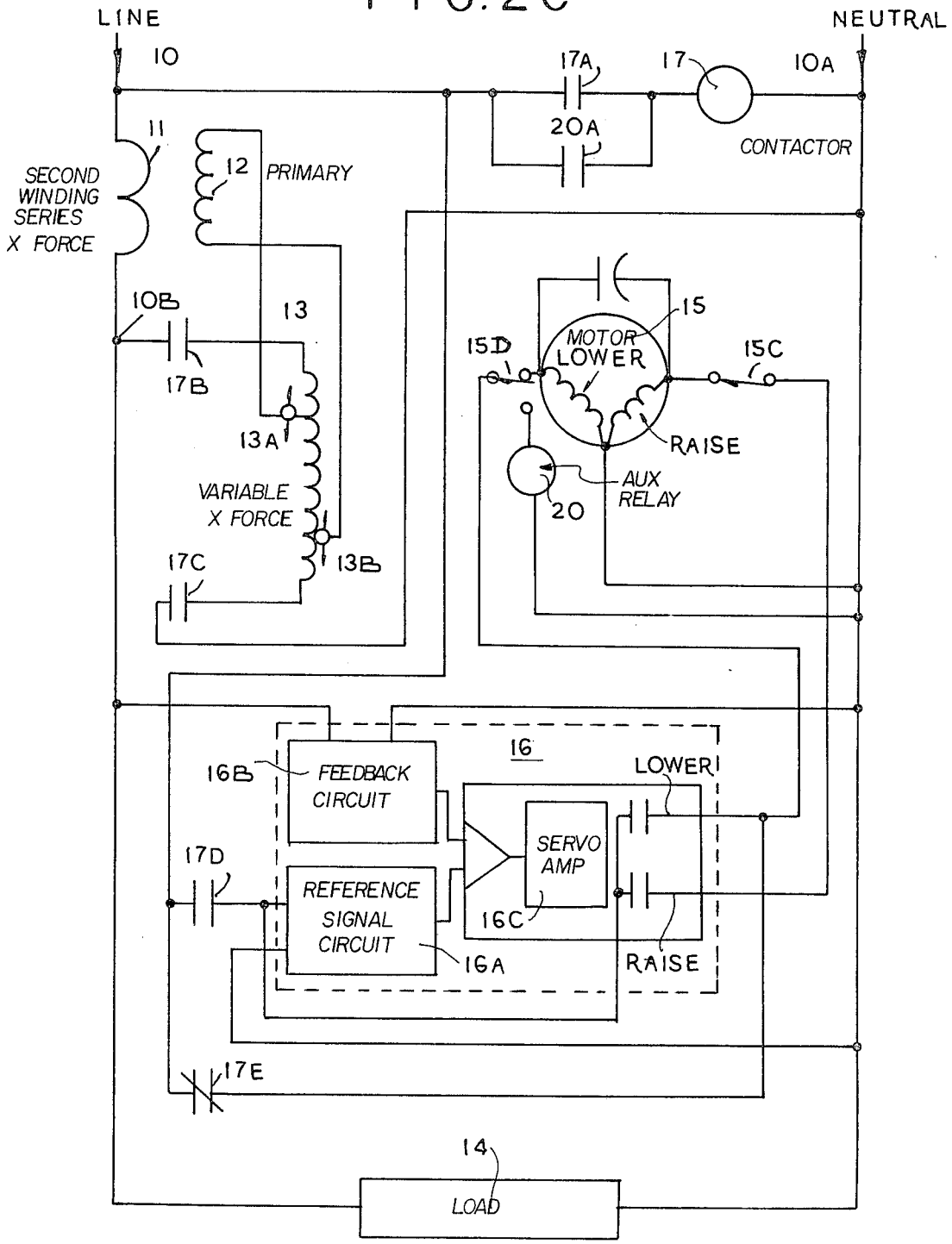
FIG. 2C represents a diagram indicating a modified circuit arrangement of that shown on FIG. 2.

FIG. 2C represents a diagrammatic illustration of a modified arrangement of that shown on FIG. 2 differing mainly by the substitution of a double throw limit switch denoted by the reference numeral 15D for the separate limit switch 15F. The double throw limit switch serves a double purpose: first to stop the variable transformer setting at its low extreme limit and secondly to re-energize the coil of the contactor 17 by means of a NO contact 20A of an auxiliary relay denoted by the numeral 20.

Otherwise all other similar component elements are denoted by like reference characters, so no further details are given.

Figure 2D:
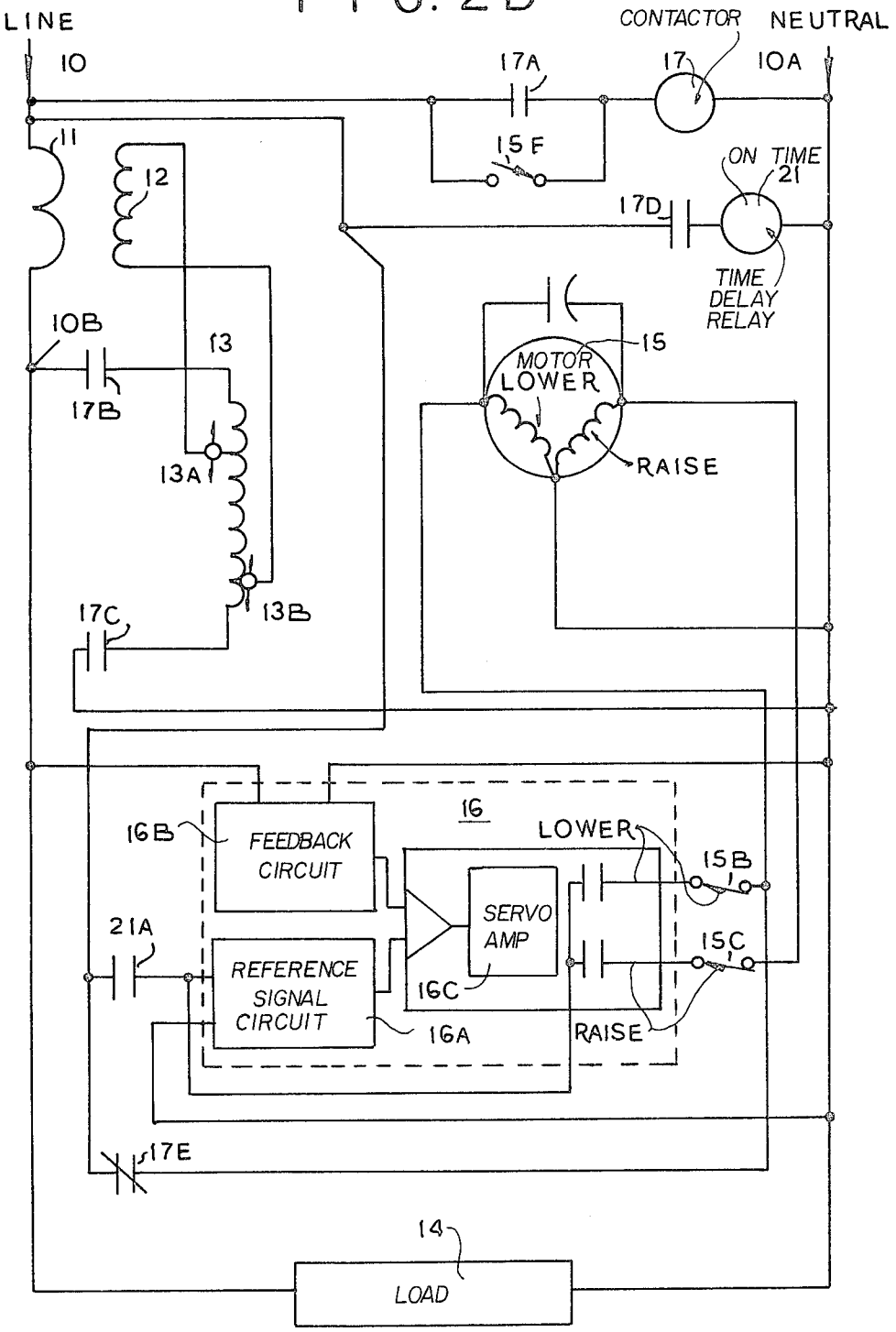
FIG. 2D represents a diagrammatic illustration of another modified embodiment of the Turn-On control system applying a time-delay device.

FIG. 2D represents a diagrammatic illustration of another modified embodiment of the invention described in FIG. 2 differing mainly by the addition of an ON-TIME Time Delay relay serving a specific purpose to be explained hereinafter.

During the test operation of the Turn-ON control system in accordance with the invention, it has been at times observed that the limited very short time interval of the switching action from "Lower" to "Raise" was insufficient to release the brake of the brake motor and to bring said motor to a full stop, thereby to make possible the motor to reverse its rotation as required to perform the reversing control action. As a consequence, this condition at test caused a mechanical damage of the driving gear and/or motor coupling.

In this application, the preferred motor driving the gear to actuate the motion of the current collectors (carbon-rollers) has been shown as a compacitor-start type with main and auxiliary windings being particularly suitable for large Computer Voltage Stabilizers due to its quality of developing a sufficient starting torque. Of course, any other type of motor may be used, so the invention is not limited thereto.

In addition, some sort of SPDT switch or reversing contactor must be inserted into the motor circuit for switching from the "Lower" to "Raise" relay contacts and vice-versa, since the direction of rotation is determined by the relative direction of the current in the main and auxiliary windings of the single phase motor. For Computer Voltage stabilization a brake motor is used to have a built-in brake being actuated by springs when all motor windings including the brake-winding are de-energized.

For a better clarification, the above noted damaging effect on the motor drive structure is mainly caused by the fact that the torque produced by the main winding is already in action in the lower direction and is substantially larger than the opposing torque produced by the reversing auxiliary winding; consequently the current collectors (carbon rollers) are still forced to continue running in the lower direction despite the reversal of the regulator's control action.

Note that both the brake and reversing contactor are not shown here in order to simplify the presentation on the basic features of the invention.

In order to prevent the occurrence of the noted damaging effect, an ON-TIME Time Delay Relay denoted by the reference numeral 21 is inserted between the service line 10 and neutral 10A. However, its cooperating contact 21A replaces contact 17D and is interconnected with the automatic regulator unit 16 to turn-on its control action. Accordingly, the contact 17D is relocated in series with the Time Delay Relay 21 to energize same at first to provide a time delay effect on the regulator's control action which, in turn, is actuated by its cooperating contact 21A.

As a result, the motor gains sufficient time to achieve a full stop before the controlled reversal of the motion of the current collctors (carbon rollers) can take place.

Otherwise all other similar component elements are denoted by like reference characters, so no further details are given.

What I claim as new and desire to secure by Letters Patent of the United States is:

1. A turn-on control system for voltage compensation means being fed from incoming service lines, said system comprising, in combination:

compensating transformer means including primary winding means and secondary winding means, said secondary winding means being connected in series with said service lines;

variable voltage corrective transformer means connected across said primary winding means for feeding corrective power thereto and thence to induce into said secondary winding means corrective voltage;

voltage detection control means having automation responsive to the presence of line voltage, for disconnecting said variable voltage transformer corrective means from its input lines upon occurrence of a power blackout and for placing said variable voltage corrective transformer means as a damping load across said primary winding means, said secondary winding means acting as a primary winding means and said primary winding means acting as a secondary winding means while said variable voltage corrective transformer means is so connected and said voltage detection control means disabling itself, its automation and said compensating transformer means;

means responsive to restoration of power for setting said variable voltage corrective transformer means to its lowest voltage compensating point;

and means operative subsequently to settling of said variable voltage corrective transformer means to its lowest voltage compensating point for reconnecting said variable voltage corrective transformer means to its input and for effecting restoration of said primary winding and secondary winding means to their normal respective functions whereupon said voltage detection control means, its automation and said compensating transformer means are restored.

2. Turn-On control system for series variable transformer type voltage drop compensators being fed from Utility's incoming service line comprising, in combination, a series transformer with primary and secondary windings, a variable voltage transformer with rolling contacts, a voltage sensing contactor-coil, five switching contacts, regulating control means, a motor setting control unit, limit switching contact, said secondary winding being connected in series with said incoming service line, said primary winding being fed in operational relationship from said variable voltage transformer, said contactor-coil interconnected with said incoming service line being operatively interlocked with said five switching contacts, said motor setting control unit adapted to control the setting of said variable voltage transformer, said regulating control means adapted to sense the voltage deviations of the corrected output of said incoming line voltage with respect to a given reference voltage to actuate said motor setting unit for setting said variable voltage transformer for correct compensation, said variable voltage transformer assumes its highest positive corrective position upon occurrence of a slow power blackout, said contactor-coil being adapted to actuate said five switching contacts to perform switching operations upon occurrence of blackout and restoration of power, said first of said five switching contacts being connected in series with said contactor-coil, said second and third switching contacts being inserted into the input terminals of said variable transformer, said fourth switching contact being connected in series with said regulating control means, said fifth switching contact being connected to said motor setting control unit, said limit switching contact being connected in parallel with said first switching contact, said first, second, third, fourth switching contacts are closed and said fifth and limit switching contacts are open when said contactor-coil is energized, upon occurrence of a power blackout said contactor-coil becomes de-energized and actuates the opening of said first, second, third and fourth switching contacts and the closing of said fifth switching contact, upon restoration of power said closed fifth switching contact energizes said motor setting control unit for resetting said variable voltage transformer to its lowest corrective position, said limit switching contact recloses to re-energize said contactor-coil causing the subsequent re-closing of said first, second, third and fourth switching contacts to provide the reconnection of said variable voltage transformer and said regulating control means to resume automatic corrective operation, thereby preventing upon restoration of power the occurrence of steady state over-voltage.

3. The structure as defined in claim 2 wherein the de-energization of said contactor-coil and following drop-out causes the cutting-off of the input power into said variable voltage transformer with subsequent functional reversal of the windings of said series transformer, whereby said secondary winding becomes the primary and said primary becomes the secondary.

4. The structure as defined in claim 3 wherein the functional reversal of said series transformer windings causing said secondary winding to form a closed damping circuit through said variable voltage transformer providing a choke effect with subsequent slight voltage drop on the power line input voltage with respect to a given reference voltage, whereby the output voltage becomes equal to said input voltage reduced by said slight voltage drop.

5. The structure as defined in claim 2 wherein said variable voltage transformer further comprises rolling current collectors being controlled by said motor setting control unit.

6. The structure as defined in claim 2 wherein the said resetting of the variable voltage transformer is accomplished by the controlling movement in the lower direction of said motor setting control unit being interlocked with said rolling current collectors to effect a displacement until their lowest extreme corrective position is reached, thereby said limit switching contact becomes closed to re-energize said contactor-coil.

7. The structure as defined in claim 2 wherein the re-energization of said contactor-coil actuates the closing of said first, second, third and fourth switching contacts, the closing of said first switching contact closes the feeding circuit of power flow into said contactor-coil, the closing of said second and third switching contacts re-energize said variable voltage transformer, the closing of said fourth switching contact re-energizes said regulating control means.

8. The structure as defined in claim 2 further comprises a relay means being operatively interlocked with a double throw limit switching contact, said double throw switching contact being substituted for said limit switching contact to actuate both the re-energization of said contactor-coil and the stoppage of the setting of the rolling current collectors of said variable voltage transformer at their lowest corrective position.

9. The structure as defined in claim 2 further comprises a time delay relay means connected to the Utility's incoming service line being operatively interlocked with an additional sixth switching contact connected in series with said regulating means, said fourth switching contact being reconnected in series with said time delay relay means, thereby to provide a time delay effect on the control action of said regulating control means.

10. The structure as defined in claim 2 wherein the re-energization of said contactor-coil causes also the re-opening of said fifth switching contact and subsequent re-opening of said limit switching contact, thereby to complete the full cycle operation of said Turn-On control system.

* * * * *

UNITED STATES PATENT AND TRADEMARK OFFICE

CERTIFICATE OF CORRECTION

PATENT NO. : 4,438,387

DATED : March 20, 1984

INVENTOR(S) : Frederick Rohatyn

It is certified that error appears in the above-identified patent and that said Letters Patent are hereby corrected as shown below:

On the title page Item (76)

The inventor's last name is corrected from "Rohatin" to --- Rohatyn ---.

At column 1, line 40, "diastrous" should be --- disastrous ---.

At column 7, line 49, correct "compacitor" to --- capacitor ---.

Signed and Sealed this

*Twenty-third* Day of *April 1985*

[SEAL]

*Attest:*

DONALD J. QUIGG

*Attesting Officer* *Acting Commissioner of Patents and Trademarks*